United States Patent [19]

Kristen et al.

[11] Patent Number: 4,713,186

[45] Date of Patent: Dec. 15, 1987

[54] LUBRICANT ADDITIVE IN POWDER TO PASTE FORM

[75] Inventors: Ulrich Kristen, Rheinfelden; Ulrich Häring, Riehen; Francis Fischer, Sins; Alain Cron, Hildisrieden, all of Switzerland

[73] Assignees: Lonza Ltd., Gampel; Ciba-Geigy A.G., Basel, both of Switzerland

[21] Appl. No.: 898,193

[22] Filed: Aug. 20, 1986

[30] Foreign Application Priority Data

Sep. 9, 1985 [CH] Switzerland ..... 03880/85

[51] Int. Cl.[4] ..... C10M 125/02; C10M 125/00; C10M 137/10

[52] U.S. Cl. ..... 252/30; 252/25; 252/29; 252/49.8

[58] Field of Search ..... 252/29, 30, 25

[56] References Cited

U.S. PATENT DOCUMENTS

| | | | |
|---|---|---|---|
| 3,344,065 | 9/1967 | Gansheimer et al. | 252/25 |
| 3,525,692 | 8/1970 | Dodson et al. | 252/29 |
| 4,206,061 | 6/1980 | Dodson et al. | 252/29 |
| 4,228,020 | 10/1980 | Papay | 252/29 |
| 4,314,907 | 2/1982 | Defretin et al. | 252/29 |

*Primary Examiner*—William R. Dixon, Jr.
*Assistant Examiner*—Ellen M. McAvoy
*Attorney, Agent, or Firm*—Fisher, Christen & Sabol

[57] ABSTRACT

Compositions, which are obtained by mixing and/or, optionally simultaneously, grinding a preferably liquid phosphate and a solid lubricant component, such as, graphite, are very suitable as additives for lubicants.

25 Claims, No Drawings

LUBRICANT ADDITIVE IN POWDER TO PASTE FORM

BACKGROUND OF THE INVENTION

1.Field of the Invention

The invention relates to compositions which can be obtained by mixing and/or grinding a phosphate and a solid lubricant component, as well as lubricants containing such compounds in mixed and/or ground form.

2.Prior art

It is known to mix a solid lubricant, for example molybdenum disulfide or graphite, with lubricants, such as oil or fats. West German OS No. 2,104,041 and West German OS No. 2,921,620 describe admixing the addition products of dialkyldithiophosphoric acids to lubricating oil as lubricant additives in amounts of 0.1 to 5 percent by weight. Disadvantages of the solid lubricants are, for example, the corrosiveness of molybdenum disulfide, on the one hand, or the poor adhesion of graphite to metallic surfaces, on the other hand. To attain a noticeable improvement of the lubricating performance, additives of addition compounds of phosphates must be applied in relatively large amounts.

BROAD DESCRIPTION OF THE INVENTION

An object of the invention is to provide lubricants and lubricant additives which overcome the above noted disadvantages of the prior art. Other objects and advantages of the invention are set out herein or are obvious herefrom to one skilled in the art.

The objects and advantages of the invention are achieved by the compositions and process of the invention.

Surprisingly a class of compositions has been found which is remarkable for easy processability and easy handling, exhibits a high lubricating performance, does not act in a corrosive manner and shows an extremely large strength in compression. The invention relates to compositions which can be obtained by mixing and/or grinding a phosphate and a solid lubricant component.

The phosphates to be used according to the invention are known compounds and are described, for example, in West German OS No. 2,104,041, U.S. Pat. No. 4,456,539 and U.S. Pat. No. 3,919,158 (the pertinent parts of such three documents being incorporated herein by reference). But the scope of the appended claims is not to be restricted so as to exclude phosphates which are discovered in the future which provide operable embodiments of the invention.

Broadly examples of useful phosphates are the phosphates of general formula I, II or III:

(I)

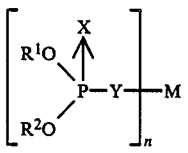

(II)

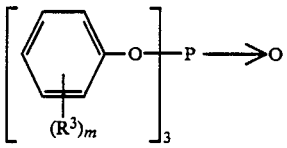

-continued (III)

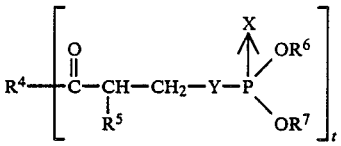

wherein $R^1$ and $R^2$ are the same or different and are $C_1$–$C_{25}$ alkyl, or phenyl or naphthyl unsubstituted or substituted with one to three $C_1$–$C_8$ alkyl groups, X and Y are the same or different and are oxygen or sulfur, $R^3$ is $C_1$–$C_5$ alkyl, $R^4$ is an alkoxy radical which is derived from an aliphatic $C_2$–$C_{20}$ alcohol having 1 to 4 hydroxy groups, $R^5$ is hydrogen or $C_1$–$C_3$ alkyl, $R^6$ and $R^7$ are the same or different and are $C_1$–$C_{20}$ alkyl, $C_5$–$C_8$ cycloalkyl, or phenyl or naphthyl unsubstituted or substituted with one to three $C_1$–$C_8$ alkyl groups, M is a metal cation or ammonium, n is a whole number corresponding to the valence of cation M, t is a whole number from 1 to 4 which corresponds to the functionality of the alcohol from which radical $R^4$ is derived, and m is a whole number from 0 to 3.

The meanings of $R^1$, $R^2$, M and n in U.S. Pat. No. 4,456,539 are incorporated herein by reference. Preferably at least one of the radicals X and Y is sulfur, but especially both are sulfur. M preferably is Zn.

The meanings of $R^3$ in U.S. Pat. No. 3,919,158 are incorporated herein by reference. The preferred meaning of $R^3$ is isopropyl and of m is 1, 2 or 3, as well as mixtures thereof.

The meanings of $R^4$, $R^5$, $R^6$, $R^7$ and t in West German OS No. 2,104,041 are incorporated herein by reference. Preferably at least one of the radicals X and Y is sulfur, but especially both are sulfur. Of special interest is the phosphate (iso-$C_3H_7O)_2P(S)$—S—$CH_2$—$CH_2COOC_2H_5$.

Preferably 10 to 50 percent by weight of the phosphate is used. Special interest is accorded to liquid phosphates.

The solid lubricant component or its mixtures is used especially in amounts of 50 to 90 percent by weight and can be selected from the series composed of graphite, the bisulfides and selenides of Mo, Nb, Ta, Ti and W, boron nitride and lead sulfide, from the intercalation compounds of graphite with the metal chlorides $NiCl_2$, $CoCl_2$, $CrCl_3$, $YCl_3$, $PtCl_4$, $RuCl_3$, $PdCl_2$ $RhCl_3$ and $AlCl_3$, graphite with the metals Co, Ni, Fe, Cu, Rh, Pt, Pd and, Ru and the graphite fluorides (CFx)n, wherein x is greater than 1.

The solid lubricant component can be homogeneous as well as also represent a mixture of the mentioned solid lubricant components among themselves.

Advantageously as a solid lubricant a graphite is used in lubricant quality, having a carbon content greater than 85 percent and (preferably greater than 90 percent), and having a crystalline length $L_c$ greater than 50 nm (preferably greater than 60 nm).

Specially preferred compositions contain 5 to 35 percent by weight of the compound (iso—$C_3H_7O)_2P(S)$—S—$CH_2$—$CH_2$—$COOC_2H_5$ and 65 to 95 percent by weight of a graphite in lubricant quality with a carbon content greater than 85 percent (preferably greater than 90 percent) and a crystalline length $L_c$ greater than 50 nm (preferably greater than 60 nm).

The compositions according to the invention are so produced that the solid lubricant component by constant mixing in the presence of the phosphate are in direct contact with each other, whereby active fracture surfaces can be produced. The production process, accordingly, can be a simultaneous mixing and grinding process, whereby advantageously new fracture surfaces are produced on the individual particles of the solid lubricant component by a mixing and/or grinding operation, preferably in a ball mill. As examples of mills which can be used, aside from the ball mill, generally mills with loose grinding devices, impact pulverizers, e.g., hammer mills, impact mills, jet mills, or, in the sense of wet grinding, also a roller mill.

The lubricant components can be ground in the sense of a wet grinding in one of the mills mentioned and suitable for wet grinding, by the phosphate simultaneously serving as grinding liquid or by performing the grinding, e.g., in the presence of a liquid lubricant or a solvent for the phosphate. Furthermore, it is advantageous to premix the lubricant additive component, e.g., in a kneader and to subject the premixed product to grinding, as described.

The compounds according to the invention are especially suitable as additives to lubricants and lead to an improvement of the high-pressure and anti-wear properties; furthermore, their anticorrosive action is pointed out. Moreover, finally the production of so-called master batches is possible.

The compounds according to the invention are effective even in very small amounts as additives in lubricants. They are added to the lubricants in an amount of 0.1 to 10 percent by weight, preferably in an amount of 0.5 to 6 percent by weight, in relation to the lubricant. The possible lubricants are familiar to one skilled in the art and are described, e.g., in "Schmierstoffe und verwandte Produkte" (Lubricants and Related Products), (Verlag Chemie, Weinheim, 1982). Especially suitable, in addition to lubricating grease, are for example mineral oils, poly-α-olefins, lubricants on ester basis, phosphates, glycols and polyalkylene glycols.

The lubricants can, in addition, contain other additives which are added to improve the fundamental properties of lubricants even further. Such additives include: antioxidants, metal passivators, rust inhibitors, viscosity index improvers, pour point depressants, dispersants, detergents, high-pressure additives and anti-wear additives.

DETAILED DESCRIPTION OF THE INVENTION

As used herein, all parts, percentages, ratios and preparations are on a weight basis unless otherwise stated herein or otherwise obvious herefrom to one skilled in the art.

Examples of useful phenolic antioxidants are:

1. Alkylated monophenols 2,6-di-tert-butyl-4-methylphenol
2,6-di-tert-butylphenol
2-tert-butyl-4,6-dimethylphenol
2,6-di-tert-butyl-4-ethylphenol
2,6-di-tert-butyl-4-ethylphenol
2,6-di-tert-butyl-4-n-butylphenol
2,6-di-tert-butyl-4-iso-butylphenol
2,6-di-cyclopentyl-4-methylphenol
2-(α-methylcyclohexyl)-4,6-dimethylphenol
2,6-di-octadecyl-4-methylphenol
2,4,6-tri-cyclohexylphenol
2-tert-butylphenol 2. Alkylated hydroquinones 2,6-di-tert-butyl-4-methoxyphenol
2,5-di-tert-butyl-hydroquinone
2,5-di-tert-amyl-hydroquinone
2,6-diphenyl-4-octadecyloxyphenol 3. Hydroxylated thiodiphenyl ethers 2,2'-thio-bis-(6-tert-butyl-4-methylphenol)
2,2'-thio-bis-(4-octylphenol)
4,4'-thio-bis-(6-tert-butyl-3-methylphenol)
4,4'-thio-bis-(6-tert-butyl-2-methylphenol)

4. Alkylidene-bisphenols 2,2'-methylene-bis-(6-tert-butyl-4-methylphenol)
2,2'-methylene-bis-(6-tert-butyl-4-ethylphenol)
2,2'-methylene-bis-[4-methyl-6-(α-methylcyclohexyl)-phenol]
2,2'-methylene-bis-(4-methyl-6-cyclohexylphenol)
2,2'-methylene-bis-(6-nonyl-4-methylphenol)
2,2'-methylene-bis-(4,6-di-tert-butylphenol)
2,2'-ethylidene-bis-(4,6-di-tert-butylphenol)
2,2'-ethylidene-bis-(6-tert-butyl-4-sec-butylphenol)
2,2'-methylene-bis-[8-(α-methylbenzyl)-4-nonylphenol]
2,2'-methylene-bis-[6-(α,α-dimethylbenzyl)-4-nonylphenol]
4,4'-methylene-bis-(2,6-di-tert-butylphenol)
4,4'-methylene-bis-(6-tert-butyl-2-methylphenol)
1,1-bis-(5-tert-butyl-4-hydroxy-2-methylphenyl)-butane
2,6-di-(3-tert-butyl-5-methyl-2-hydroxybenzyl)-4-methylphenol
1,1,3-tris-(5-tert-butyl-4-hydroxy-2-methylphenyl)-3-n-dodecyl-mercaptobutane
ethylene glycol-bis-[3,3-bis-(3'-tert-butyl-4'-hydroxyphenol)-butyrate]
di-(3-tert-butyl-4-hydroxy-5-methylphenyl)-dicyclopentadiene
di-[2-(3'-tert-butyl-2'-hydroxy-5'-methyl-benzyl)-6-tert-butyl-4-methylphenyl]-terephthalate.

5. Benzyl compounds 1,3,5-tri-(3,5-di-tert-butyl-4-hydroxybenzyl)-2,4,6-trimethylbenzene
di-(3,5-di-tert-butyl-4-hydroxybenzyl)-sulfide
3,5-di-tert-butyl-4-hydroxybenzyl-mercaptoacetic acid isooctyl ester
bis-(4-tert-butyl-3-hydroxy-2,6-dimethylbenzyl)-dithiolterephthalate
1,3,5-tris-(3,5-di-tert-butyl-4-hydroxybenzyl)-isocyanurate
1,3,5-tris-(4-tert-butyl-3-hydroxy-2,6-dimethylbenzyl)-isocyanurate
3,5-di-tert-butyl-4-hydroxybenzyl-phosphonic acid dioctadecyl ester
3,5-di-tert-butyl-4-hydroxybenzyl-phosphonic acid monoethyl ester calcium salt 6. Acylaminophenols 4-hydroxy-lauric acid anilide
4-hydroxy-stearic acid anilide
2,4-bis-octylmercapto-6-(3,5-di-tert-butyl-4-hydroxyanilino)-s-triazine
N-(3,5-di-tert-butyl-4-hydroxyphenyl)-carbamic acid octyl ester 7. Esters of β-(3,5-di-tert-butyl-4-hydroxyphenyl)-propionic acid with monovalent or multivalent alcohols, such as with methanol
octadecanol
1,6-hexanediol
neopentyl glycol
thiodiethylene glycol
diethylene glycol
triethylene glycol pentaerythrite
tri-hydroxyethyl-isocyanurate
di-hydroxyethyl-oxalic acid diamide 8. Esters of β-(5-tert-butyl-4-hydroxy-3-methylphenyl)-propionic acid with monovalent or polyvalent alcohols, such as:
methanol
octadecanol
1,6-hexanediol
neopentyl glycol
diethylene glycol
triethylene glycol
pentaerythrite
tri-hydroxyethyl-isocyanurate
thiodiethylene glycol
di-hydroxyethyl-oxalic acid diamide 9. Amides of β-(3,5-di-tert-butyl-4-hydroxyphenyl)-propionic acid such as:
N,N'-di-(3,5-di-tert-butyl-4-hydroxyphenylpropionyl)-hexamethylenediamine
N,N'-di-(3,5-di-tert-butyl-4-hydroxyphenylpropionyl)-trimethylenediamine
N,N'-di-(3,5-di-tert-butyl-4-hydroxyphenylpropionyl)-hydrazine Examples of useful amine antioxidants are:
N,N'-di-isopropyl-p-phenylenediamine
N,N'-di-sec-butyl-p-phenylenediamine
N,N'-bis-(1,4-dimethyl-pentyl)-p-phenylenediamine
N,N'-bis-(1-ethyl-3-methyl-pentyl)-p-phenylenediamine
N,N'-bis-(1-methyl-heptyl)-p-phenylenediamine
N,N'-diphenyl-p-phenylenediamine
N,N'-di-(naphthyl-2)-p-phenylenediamine
N-isopropyl-N'-phenyl-p-phenylenediamine
N-(1,3-dimethyl-butyl)-N'-phenyl-p-phenylenediamine
N-(1-methyl-heptyl)-N'-phenyl-p-phenylenediamine
N-cyclohexyl-N'-phenyl-p-phenylenediamine
4-(p-toluol-sulfonamido)-diphenylamine
N,N'-dimethyl-N,N'-di-sec-butyl-p-phenylenediamine
diphenylamine
4-isopropoxy-diphenylamine
N-phenyl-1-naphthylamine
N-phenyl-2-naphthylamine
octylated diphenylamine
4-n-butylaminophenol
4-butyrylaminophenol
4-nonanoylaminophenol
4-dodecanoylaminophenol
4-octadecanoylaminophenol
di-(4-methoxy-phenyl)-amine
2,6-di-tert-butyl-4-dimethylaminomethyl phenol
2,4'-diamino-diphenylmethane
4,4'-diamino-diphenylmethane
N,N,N',N'-tetramethyl-4,4'-diaminodiphenylmethane
1,2-di-[(2-methyl-phenyl)-amino]-ethane
1,2-di-(phenylamino)-propane
(o-tolyl)-biguanide
di-[4-(1',3'-dimethyl-butyl)-phenyl]-amine
tert-octylated N-phenyl-1-naphthylamine
mixture of mono- and dialkylated tert-butyl-/tertoctyl-diphenylamines Examples of useful metal passivators are: for copper, e.g.: triazoles, benztriazoles, tetrahydrobenztriazoles, 2-mercaptobenzothiazole, 2,5-dimercaptothiadiazole, salicylidine-propylenediamine, and salts of salicylaminoguanidine.

Examples of useful rust inhibitors are:
(a) Organic acids, and their esters, metal salts and anhydrides, e.g.: N-oleoyl-sarcosine, sorbitan-monooleate, lead-naphthenate, dodeceylsuccinic acid anhydride, alkenylsuccinic acid semiester and 4--nonylphenoxy acetic acid.
(b) Compounds containing nitrogen, e.g:
I. Primary, secondary or tertiary aliphatic or cycloaliphatic amines and amine salts of organic and inorganic acids, e.g., oil-soluble alkylammonium carboxylates.
II. Heterocyclical compounds, e.g.: substituted imidazolines and oxazolines.
(c) Compounds containing phosphorous, e.g.: amine salts of phosphoric partial esters.
(d) Compounds containing sulfur, e.g.: barium dinonylnaphthaline sulfonates and calcium petroleum sulfonates.

Examples of useful viscosity index improvers are, e.g.: polymethacrylates, vinylpyrrolidone/methacrylate-copolymers, polybutenes, olefin copolymers and styrene/acrylate copolymers.

Examples of useful pour-point depressants are, e.g.: polymethacrylate and alkylated naphthalene derivatives Examples for dispersants/surfactants are, e.g.: polybutenylsuccinic acid imides, polybutenylphosphonic acid derivatives, and basic magnesium-, calcium- and barium-sulfonates and -phenolates.

Examples of useful wear protection additives are, e.g.: sulfur, sulfur and/or phosphorus and/or halogen containing compounds, such as sulfurized vegetables oils, zinc dialkyldithiophosphates, tritolyl chlorinated paraffins, and alkyl and aryl disulfides.

As used herein, $C_1$–$C_{25}$ alkyl groups include methyl, ethyl, propyl, butyl, pentyl, hexyl, heptyl octyl, nonyl, decyl, undecyl, dodecyl, tridecyl tetradecyl, pentadecyl, hexadecyl, octadecyl, nonadecyl, eicosyl, heneicosyl, docosyl, tricosyl, tetracosyl and pentacosyl, isopropyl, isobutyl, isoamyl, 2-pentyl, 2-methyl-1-pentyl, 3-methyl-1-pentyl, isohexyl, 2-ethyl-1-butyl, 3-hexyl, 2-methyl-2-pentyl and 2-ethyl-1-hexyl.

As used herein, phenyl groups substituted with one to three $C_1$–$C_8$ alkyl groups include 2-methylphenyl, 3-methylphenyl, 2,3-dimethylphenyl, 2,4-dimethylphenyl, 2,5-dimethylphenyl, 2,6-dimethylphenyl, 3,4-dimethylphenyl, 3,5-methylphenyl, 2-ethylphenyl, 3-ethylphenyl, 4-ethylphenyl, 4-methylphenyl, 2-propylphenyl, 4-propylphenyl, 2,3,4-trimethylphenyl, 2,3,5-trimethylphenyl, 2,3,6-trimethylphenyl, 2,4,5-trimethylphenyl, 2,4,6-trimethylphenyl, 3,4,5-trimethylphenyl, 3-butylphenyl, 2-ethyl-isobutylphenyl, 3-ethyl-2-methylphenyl, 2-ethyl-4-propylphenyl, 3-pentylphenyl, 3-isobutylphenyl, 3-isopropylphenyl, 4-isopropylphenyl, 2-methyl-4-propylphenyl, 4-butylphenyl, 2,3,5-triethylphenyl, 3-heptylphenyl and 2-hexylphenyl.

As used herein naphthyl groups substituted with one to three $C_1$–$C_8$ alkyl groups include 2,3-dimethylnaphthyl, 2-methylnaphthyl, 1-methylnaphthyl, 1-ethylnaphthyl, 2-ethylnaphthyl, 2-hexylnaphthyl, 2-propylnaphthyl, 2-isopropylnaphthyl, 1-heptylnaphthyl, 2-pentylnaphthyl and 2-butylphenyl.

As used herein, $C_5$–$C_8$ cycloalkyl groups include cyclopentane, cyclohexane, cycloheptane and cyclooctane.

As used herein, alkoxy groups which are derived from aliphatic $C_2$–$C_{20}$ alcohols having 1 to 4 hydroxy groups include ethoxy, propoxy, ispropoxy, butoxy, 2-hydroxypropoxy, 3-hydroxypropoxy, 2-hydroxbutoxy, 2,3,3-trihydroxybutoxy, 3-hydroxybutoxy, 4-hydroxypentoxy, 4-hydroxyheptoxy, 5-hydroxyhexoxy, 4-hydroxynonoxy and 10-hydroxydecoxy.

As used herein, M includes Li, Na, K, Rb, Cs, Be, Mg, Ca, Sr, Ba, Ti, Zr, V, Cr, Mn, Fe, Co, Ni, Cu, Zn, Al, Ga, Ge, Sb, Sn, Cd, Ag, Pd, Rd, Ru, Mo, W, Os, Ir, Au, Hg, Pb, Bi, Cs, U, Pu and Ce.

The purpose of the following examples is to explain the invention in more detail:

EXAMPLE 1

8 kg of graphite (99.9 percent carbon content, crystalline length $L_c$ greater than 100 nm) and 4 kg of phosphate of the formula (iso—$C_3H_7O)_2P(S)$—S—$CH_2CH_2COOC_2H_5$ was premixed in a kneader to homogeneity, and then the mixture was transferred to a ball mill. Grinding took place over a period of 30 minutes. A lightly pasty mass could then be taken from the mill. As a test matrix for the effectiveness of the compound according to the invention, a basic fat of the consistency NLGI2 (lithium-12-hydroxystearate) was used. Lubricants each containing 2 percent by weight and 6 percent by weight of the lubricant additive according to the invention in the basic fat were prepared and subjected to various measurements.

EXAMPLE 2

The following value (in the following Table) was determined with a Shell Four-Ball Machine (1P 239/73, "Extreme pressure and wear lubricant test for oils and greases", Four Ball machine) for each of the below listed lubricants:

W.L. is weld load, that is, the load at which the four balls fuse within 10 seconds.

| Lubricant | Ingredients | WL (N) | |
|---|---|---|---|
| Comparison | basic fat | 1600 | |
| | | additive to basic fat | |
| | | 2% by weight | 6% by weight |
| | basic fat + graphite | 1800 | 2800 |
| | basic fat + phosphate from example 1 | 2000 | 3000 |
| According to the invention | basic fat + lubricant additive from example 1 | 2200 | 3600 |

What is claimed is:

1. Composition which has been obtained by mixing and/or grinding at least one phosphate and at least one solid lubricant component, said composition containing from 10 to 50 percent by weight of the phosphate and 50 to 90 percent by weight of the solid lubricant component, the phosphate having formula III:

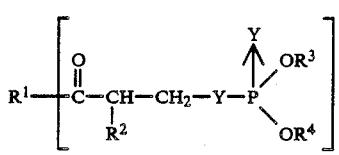

(III)

wherein X and Y are the same or different and are oxygen or sulfur, $R^1$ is an alkoxy radical which is derived from an aliphatic $C_2$–$C_{20}$ alcohol having 1 to 4 hydroxy groups, $R^2$ is hydrogen or $C_1$–$C_3$ alkyl, $R^3$ and $R^4$ are the same or different and are $C_1$–$C_{20}$ alkyl, $C_5$–$C_8$ cycloalkyl, or phenyl or naphthyl unsubstituted or substituted with one to three $C_1$–$C_8$ alkyl groups, and t is a whole number from 1 to 4 which corresponds to the functionality of the alcohol from which radical $R^1$ is derived, and the at least one solid lubricant component being graphite, a bisulfide or selenide of Mo, Nb, Ta, Ti or W, boron nitride, lead sulfide, an intercalation compound of graphite with $NiCl_2$, $CoCl_2$, $FeCl_3$, $CuCl_2$, $CrCl_3$, $YCl_3$, $PtCl_4$, $RuCl_3$, $PdCl_2$, $RhCl_3$ or $AlCl_3$, an intercalation compound of graphite with Co, Ni, Fe, Cu, Rh, Pt, Pd or Ru, and a graphite fluoride $(CF_x)_n$, wherein x is greater than one.

2. Composition according to claim 1 wherein the phosphate is (iso-$C_3H_7O)_2P(S)$—S—$CH_2CH_2COOC_2H_5$.

3. Composition according to claim 1 wherein the solid lubricant component is graphite in lubricant quality, having a carbon content greater than 85 percent and having a crystalline length $L_c$ greater than 50 nm.

4. Composition according to claim 1 wherein the solid lubricant component has been obtained from (iso-$C_3H_7O)_2P(S)$—S—$CH_2CH_2COOC_2H_5$ and a graphite of lubricant quality, having a carbon content greater than 85 percent and having a crystalline length $L_c$ greater than 50 nm.

5. Composition according to claim 4 wherein the graphite has a carbon content greater than 95 percent and has a crystalline length $L_c$ greater than 60 nm.

6. Composition according to claim 1 wherein the solid lubricant component, while forming active fracture surfaces, is mixed and/or ground with the phosphate.

7. Composition according to claim 6 wherein the solid lubricant component is mixed and simultaneously ground with the phosphate.

8. Composition according to claim 5 wherein the new fracture surfaces have been produced by a mixing and grinding operation in a ball mill.

9. Composition according to claim 1 wherein the compound has been obtained by mixing and simultaneously grinding the phosphate and the solid lubricant component.

10. Composition according to claim 1 wherein the phosphate is a liquid phosphate.

11. Process for the production of a lubricant additive in powder to paste form for lubricating oils and lubricating greases comprising mixing and comminuting 10 to 50 percent by weight of at least one phosphate as defined in claim 1 and 50 to 90 percent by weight of at least one solid lubricant component by bringing them into mutual contact in a mixing and/or comminuting device.

12. Process according to claim 11 wherein the phosphate and the solid lubricant component are brought into mutual contact in a mixing and comminuting device, whereby, while forming constantly new fracture surfaces on the individual particles of the solid lubricant components, the components are intimately mixed.

13. Lubricant containing the compound according to claim 1.

14. Composition which has been obtained by mixing and/or grinding at least one phosphate and at least one solid lubricant component, said composition containing from 10 to 50 percent by weight of the phosphate and 50 to 90 percent by weight of the solid lubricant component, the phosphate having formula I or II.

(I)

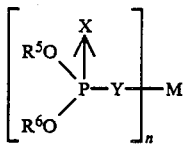

(II)

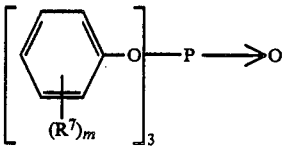

wherein $R^5$ and $R^6$ are the same or different and are $C_1$–$C_{25}$ alkyl, or phenyl or naphthyl unsubstituted or substituted with one to three $C_1$–$C_8$ alkyl groups, X and Y are the same or different and are oxygen or sulfur, $R^7$ is $C_1$–$C_5$ alkyl, M is a metal cation or ammonium, n is a whole number corresponding to the valence of cation M, and m is a whole number from 0 to 3, and the at least one solid lubricant component is graphite, a selenide of Mo, Nb, Ta, Ti and W, boron nitride, an intercalation compound of graphite with $NiCl_2$, $CoCl_2$, $FeCl_3$, $CuCl_2$, $CrCl_3$, $YCl_3$, $PtCl_4$, $RuCl_3$, $PdCl_2$, $RhCl_3$ or $AlCl_3$, an intercalation compound of graphite with the metals Co, Ni, Fe, Cu, Rh, Pt, Pd, and Ru and the graphite fluorides $(CF_x)_n$, wherein x is greater than 1, the graphite being of lubricant quality, having a carbon content greater than 85 percent and having a crystalline length $L_c$ greater than 50 nm.

15. Composition according to claim 14 wherein the phosphate is a phosphate of formula I.

16. Composition according to claim 14 wherein the phosphate is a phosphate of formula II.

17. Composition according to claim 14 wherein the graphite has a carbon content greater than 95percent and has a crystalline length $L_c$ greater than 60 nm.

18. Composition according to claim 14 wherein the solid lubricant component, while forming active fracture surfaces, is mixed and/or ground with the phosphate.

19. Composition according to claim 14 wherein the solid lubricant component is mixed and simultaneously ground with the phosphate.

20. Composition according to claim 14 wherein the new fracture surfaces have been produced by a mixing and grinding operation in a ball mill.

21. Composition according to claim 14 wherein the compound has been obtained by mixing and simultaneously grinding the phosphate and the solid lubricant component.

22. Composition according to claim 14 wherein the phosphate is a liquid phosphate.

23. Process for the production of a lubricant additive in powder to paste form for lubricating oils and lubricating greases comprising mixing and comminuting 10 to 50 percent by weight of at least one phosphate as defined in claim 14 and 50 to 90 percent by weight of at least one solid lubricant component as defined in claim 14 by bringing them into mutual contact in a mixing and/or comminuting device.

24. Process according to claim 23 wherein the phosphate and the solid lubricant component are brought into mutual contact in a mixing and comminuting device, whereby, while forming constantly new fracture surfaces on the individual particles of the solid lubricant components, the components are intimately mixed.

25. Lubricant containing the compound according to claim 14.

* * * * *